US006092943A

United States Patent [19]

Dan

[11] Patent Number: 6,092,943

[45] Date of Patent: Jul. 25, 2000

[54] APPARATUS AND METHOD FOR MEASURING PRINTING PAPER QUANTITY AND WARNING PRINTING PART EXCHANGE TIME

[75] Inventor: Kenichi Dan, Nagoya, Japan

[73] Assignee: Brother Kogyo Kabushiki Kaisha, Nagoya, Japan

[21] Appl. No.: 09/089,672

[22] Filed: Jun. 3, 1998

[30] Foreign Application Priority Data

Jun. 11, 1997 [JP] Japan ..... 9-154092
Jun. 12, 1997 [JP] Japan ..... 9-155324

[51] Int. Cl.[7] ..... B41J 33/32

[52] U.S. Cl. ..... 400/249; 400/61; 347/7; 347/19

[58] Field of Search ..... 400/249, 76, 70, 400/61; 347/7, 19

[56] References Cited

U.S. PATENT DOCUMENTS 5,021,828 6/1991 Yamaguchi et al. ..... 355/209
5,068,806 11/1991 Gatten ..... 395/113
5,132,711 7/1992 Shinada et al. ..... 346/140
5,802,420 9/1998 Garr et al. ..... 399/27
5,812,156 9/1998 Bullock et al. ..... 347/19

*Primary Examiner*—John S. Hilten
*Assistant Examiner*—Charles H. Nolan, Jr.
*Attorney, Agent, or Firm*—Oliff & Berridge, PLC

[57] ABSTRACT

In a facsimile apparatus having a printing mechanism, the number of consumed printing papers is accumulated. When an ink ribbon is exchanged, a manual reset operation is requested. In one aspect, the request is made only when the accumulated value is in excess of a predetermined reference. In another aspect, two counters are used to accumulate the number of consumed printing papers separately from each other. If one counter is not reset when the reset operation is requested and a recovery of correct accumulated value is instructed manually, the accumulated value in that counter is updated by the other accumulated value in the other counter.

28 Claims, 10 Drawing Sheets

APPARATUS AND METHOD FOR MEASURING PRINTING PAPER QUANTITY AND WARNING PRINTING PART EXCHANGE TIME

CROSS REFERENCE TO RELATED APPLICATION

This application relates to and incorporates herein by reference Japanese Patent Applications No. Hei-09-154092 filed on Jun. 11, 1997 and No. Hei-09-155324 filed on Jun. 12, 1997.

BACKGROUND OF THE INVENTION

1. Field of the Invention

The present invention relates to an apparatus and method for measuring the quantity of printing papers used in printing and warning a printing part exchange time using the measured quantity of the printing paper.

2. Description of Related Art

Of apparatuses (e.g., printer, facsimile apparatus or copying machine) having a printing mechanism, some include a warning apparatus which warns a user the time at which printing part such as ink or toner (collectively referred to as ink) should be exchanged or supplied or the time at which printing paper should be supplied.

This kind of ink exchange time warning apparatus generally comprises a printing paper quantity measuring apparatus in which contents memorized in a memory are initialized when an ink ribbon, for example, is exchanged to a new one and the number of printing papers is accumulated and memorized in the memory each time the printing is executed and a warning apparatus for warning a user when the accumulated value memorized in the memory exceeds a predetermined warning reference. If the average number of printing papers assumed to be printable without shortage of ink after the ink ribbon was exchanged to a new one is set to the warning reference, then it is possible to warn the user of the time at which the ink ribbon should be exchanged next.

In order to enable the ink exchange time warning apparatus to function normally, when the ink ribbon is exchanged to the new one, the accumulated value of the number of printing papers should always be initialized. On the other hand, in the maintenance process of the printing mechanism, for example, when the ink ribbon under use is temporarily unloaded and the same ink ribbon is loaded again, the accumulated value should not be initialized but should be maintained.

However, when the ink ribbon is unloaded/loaded, it is difficult to determine automatically whether or not the ink ribbon is exchanged to a new one in actual practice, and to automatically initialize the accumulated value.

For this reason, this kind of ink exchange time warning apparatus is arranged to display a message requesting an initialization of the accumulated number of printing papers, so that the accumulated value of the number of printing papers may be initialized or maintained in response to a manual operation of the user responsive to the request message. When the ink ribbon is exchanged to a new one, the user is enabled to execute a predetermined reset operation for initialization of the accumulated number of printing paper. On the other hand, when the ink ribbon is temporarily unloaded and loaded again, the user is enabled not to execute the reset operation. Thus, so long as a notice of handling the ink exchange time warning apparatus is determined and the user observes such a notice, the above ink exchange time warning apparatus can function normally.

It is, however, troublesome for the user, particularly to the user who unloads and loads the ink ribbon frequently, to instruct manually the initialization or maintenance of the accumulated number of printing papers at every ink ribbon maintenance process. It is also possible that the user may execute the reset operation erroneously in response to the request message display, although the initialization should not be executed because of loading of the same ink ribbon. Thus the ink exchange time warning apparatus cannot warn the user of the ink exchange time correctly. In particular, even when the user notices the operation error later, the ink exchange time warning apparatus is disabled to function normally.

SUMMARY OF THE INVENTION

It is an object of the present invention to provide an improved printing paper quantity measuring apparatus and printing part exchange time warning apparatus.

It is another object of the present invention to control a display of request message for intialization in dependence on necessity of initialization.

It is a further object of the present invention to enable a later recovery of a correct accumulated value of the number of printing papers even when a necessary reset operation is not executed or when an unnecessary reset operation is executed erroneously.

According to one aspect of the present invention, a display of a request message requesting necessity of a reset operation, initialization of a printing paper counter, at the time of unloading/loading of part of a printing mechanism. Preferably, the request message is displayed and not displayed, for instance, when the accumulated value of the number of consumed printing papers is high and low, respectively, so that the number of times of manual operation of a user is reduced to a necessary minimum.

According to another aspect of the present invention, two printing paper counters accumulates the number of consumed printing papers separately from each other. One counter is intialized when a reset operation is executed manually in response to a reset request issued at the time of an exchange of a printing part such as an ink cartridge. When a recovery of a correct value is requested after an erroneous reset operation, the accumulated value of the one counter is updated by the accumulated value of the other counter.

BRIEF DESCRIPTION OF THE DRAWINGS

Other objects, features and advantages of the present invention will become more apparent from the following deteailed description made with reference to the accompanying drawings.

DETAILED DESCRIPTION OF THE PREFERRED EMBODIMENTS

In the following embodiments, a printing paper quantity measuring apparatus and a part exchange time warning apparatus according to the present invention are applied to a facsimile apparatus.

Figure 1:
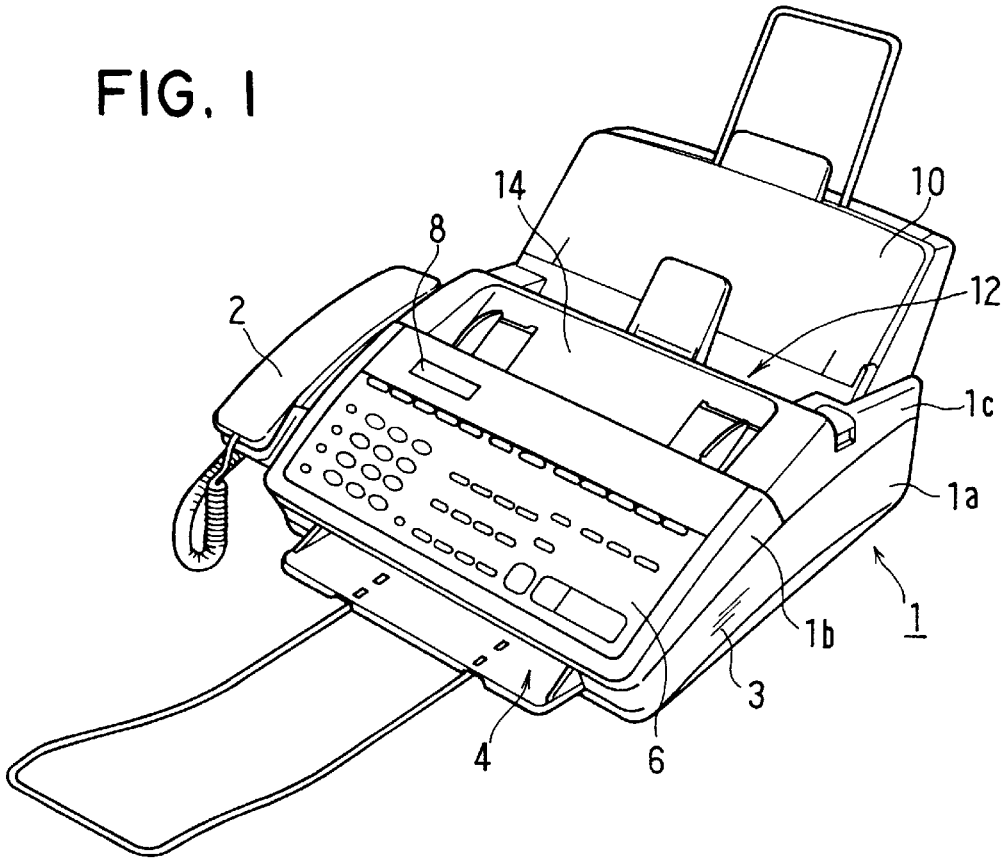
FIG. 1 is a perspective view showing a facsimile apparatus to which embodiments of the present invention is applied.

As shown in FIG. 1, a facsimile apparatus 1 has an outer casing comprising a lower case 1*a*, an operation panel 1*b* fixed to the upper front side of the lower case 1*a* and an upper cover 1*c* attached to the upper rear side of the lower case 1*a*.

To the left-hand side of the lower case 1*a*, there is attached a handset 2 used either when the facsimile apparatus 1 is operated as a telephone or when a signal sound from the exchange side is confirmed. A speaker 3 is attached to the right-hand side of the lower case 1*a* to provide transmitted and received sounds as monitor sounds. The lower case 1*a* has an original document discharge mouth 4 defined at its front surface to discharge an original document from which an image to be transmitted or duplicated is read out. On the upper surface of the operation panel 1*b*, there are disposed a key input device 6 having a number of operation keys and a liquid crystal display device (LCD) 8 capable of displaying desired characters or the like in the form of dot matrix. To the upper rear unit of the upper cover 1*c*, there is substantially vertically attached a paper feed case 10 in which sheets of new printing paper are retained. The paper feed case 10 has a printing paper discharge mouth 12 defined at its front side to discharge printing paper which was output after the printing of a received image or a duplicated image had been finished. On the upper front unit of the upper cover 1*c*, there is formed an original document holder 14 for holding an original document having an image to be read for transmission or duplication in the known manner.

Figure 2:
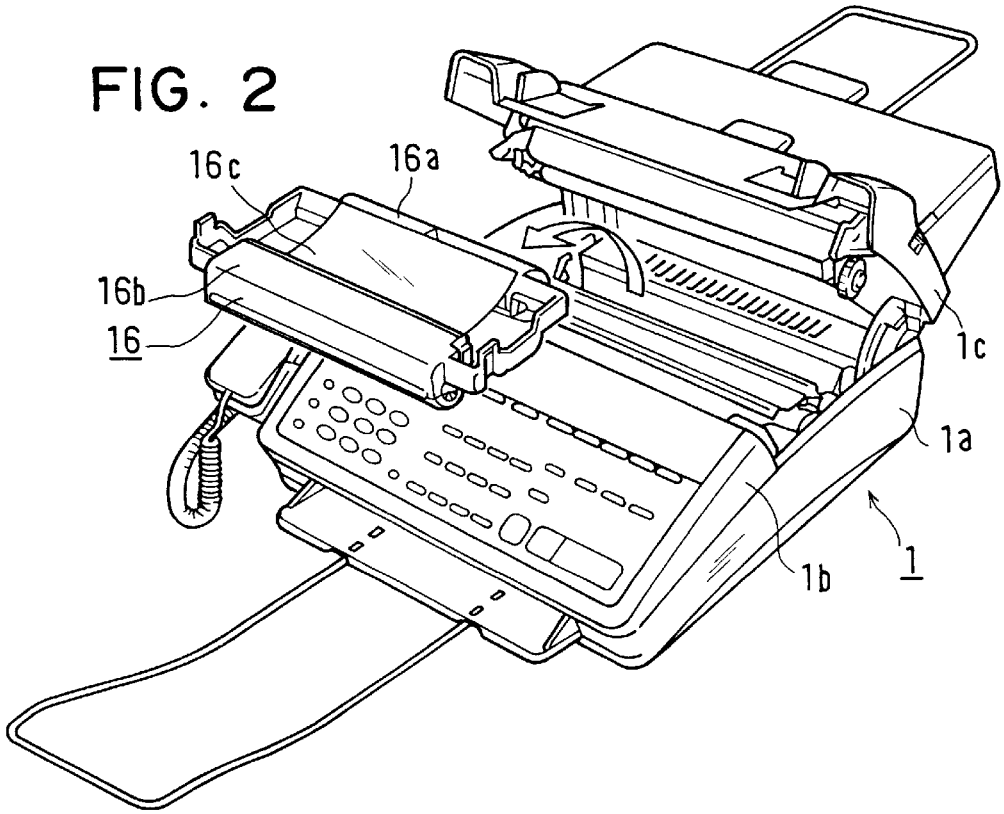
FIG. 2 is a perspective view showing the facsimile apparatus shown in FIG. 1 with its upper cover being opened to detach an ink cartridge.

As shown in FIG. 2, the upper cover 1*c* is attached to the lower case 1*a* in such a manner that it can be turned around the rear end side. The upper cover 1*c* can be upwardly turned and placed in the opened state when an ink ribbon cartridge 16 as a printer part is unloaded/loaded or a maintenance of the inside of the apparatus is executed. The ink ribbon cartridge 16 is provided with a pair of rolls respectively incorporated in an ink ribbon supply unit 16*a* and an ink ribbon collection unit 16*b*. The ink ribbon cartridge 16 extends an ink ribbon 16*c* of substantially the same width as that of the printing paper between the two rolls. In accordance with the printing, the new ink ribbon 16*c* is unreeled from the ink ribbon supply unit 16*a*. The ink ribbon collection unit 16*b* rewinds the used ink ribbon 16*c*. Ink of hot-melt property is coated on the upper surface of the ink ribbon 16*c*. Under the condition that the ink coated surface and the printing paper are superposed in contact with each other, both are transported together between a line-type printing head of substantially the same width as that of the printing paper and a platen roller and an image is printed on the printing paper in a thermal transfer system.

Figure 3:
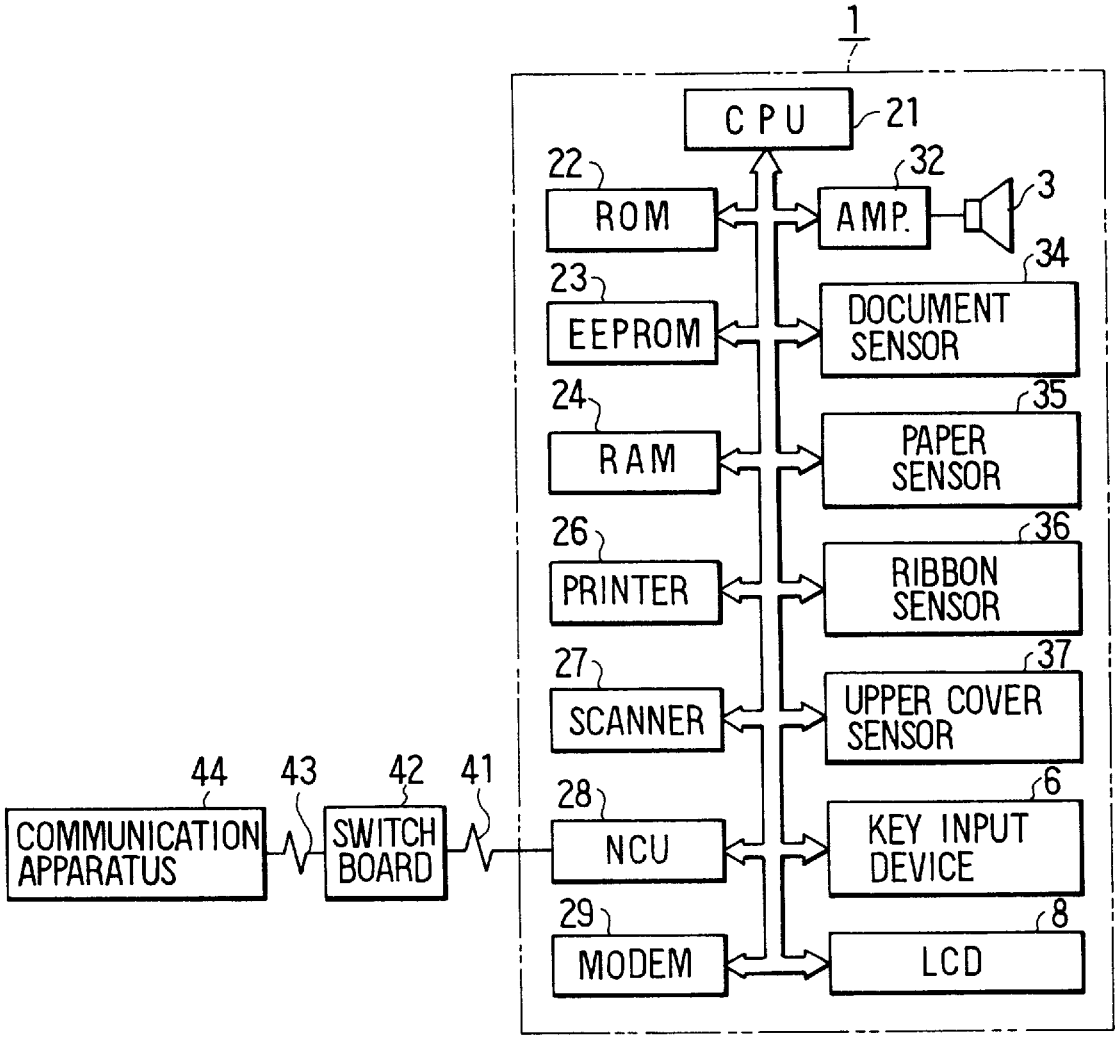
FIG. 3 is a block diagram showing a control system of the facsimile apparatus shown in FIG. 1.

As shown in FIG. 3, the control system of the facsimile apparatus 1 comprises a well-known CPU 21 for controlling an operation of each part of the apparatus. The CPU 21 is connected to a ROM 22, an EEPROM 23, a RAM 24, a printer unit 26, a scanner unit 27, a network control unit (NCU) 28, a modem 29, an amplifier 32, an original document sensor 34, a printing paper sensor 35, an ink ribbon sensor 36 and an upper cover sensor 37, etc. The upper cover sensor 37 is used to detect a manual operation associated with an ink echange operation. The CPU 21 is also connected to the key input device 6 and LCD 8.

The ROM 22 stores a control program to be executed by the CPU 21 and a variety of control data. The EEPROM 23 is a non-volatile memory capable of memorizing stored data under the condition that the apparatus is not powered. A variety of setting data that can be arbitrarily changed by the user are stored in the EEPROM 23. The RAM 24 is a memory for temporarily storing a variety of data required when an operation is executed. The RAM 24 includes therein a transmission image storage area for accumulating image data of transmitted image before transmission, a received image storage area for accumulating image data of received image before printing, an outgoing message storage area for storing an outgoing message (OGM) that should be transmitted to the other party when an automatic answering telephone function is effected and an incoming message storage area for storing an incoming message (ICM) that was sent from the other party when the automatic answering telephone function is effected.

The printer unit 26 is a mechanism for printing an image on the printing paper in a thermal transfer system. More specifically, the printer unit 26 comprises a transport motor for transporting the printing paper, a driver circuit interposed between the transport motor and the CPU 21, a line-type printing head for printing an image on the printing paper in a thermal transfer system and a driver circuit interposed between the printing head and the CPU 21. The scanner unit 27 is a mechanism for optically reading out an image of an original document that should be read out and converting the thus read-out image data into an electrical signal. More specifically, the scanner unit 27 comprises a driver circuit interposed between the transport motor and the CPU 21, a line-type image sensor for reading out the image on the original document and a driver circuit interposed between the image sensor and the CPU 21.

The NCU 28 is an apparatus for transmitting and receiving a signal between it and other facsimile apparatus via a telephone line. The modem 29 is an apparatus for modulating/demodulating a signal that should be transmitted and received. The amplifier 32 is a circuit for amplifying a sound of a signal that should be transmitted and received in order to emanate monitor sounds from the speaker 3.

Further, the original document sensor 34 is a sensor for detecting whether or not the original document is set on the original document holder 14. The printing paper sensor 35 is a sensor for detecting whether or not the printing paper is set on the paper feed case 10. The ink ribbon sensor 36 is a sensor for detecting the existence of the ink ribbon 16*c*. The upper cover sensor 37 is a sensor for detecting whether the upper cover 1*c* is opened or closed. These sensors detect whether or not detection objects exist at predetermined positions. More specifically, these sensors can be composed of a touch-sensor which is turned to ON/off in response to the touch/nontouch with the detection object, an optical sensor comprising a light-emitting element and a photo-sensing element opposed across the detection object and an optical sensor comprising a light-emitting element for emitting light toward the detected object and a photo-sensing element for receiving reflected light.

The facsimile apparatus 1 is connected through the NCU 28 to a telephone line 41 which is in turn connected to a switchboard 42. The switchboard 42 is connected to other communication apparatus 44 (facsimile apparatus, telephone etc.) through a telephone line 43. When a connection request is issued from one device of the facsimile apparatus 1 and other communication apparatus 44 to the other device, the switchboard calls the other device. If the other communication apparatus 44 answers, then the switchboard 42 connects the facsimile apparatus 1 and the other communication apparatus 44, thereby resulting in a communication being made between the facsimile apparatus 1 and the other communication apparatus 44.

(First Embodiment)

Figure 4:
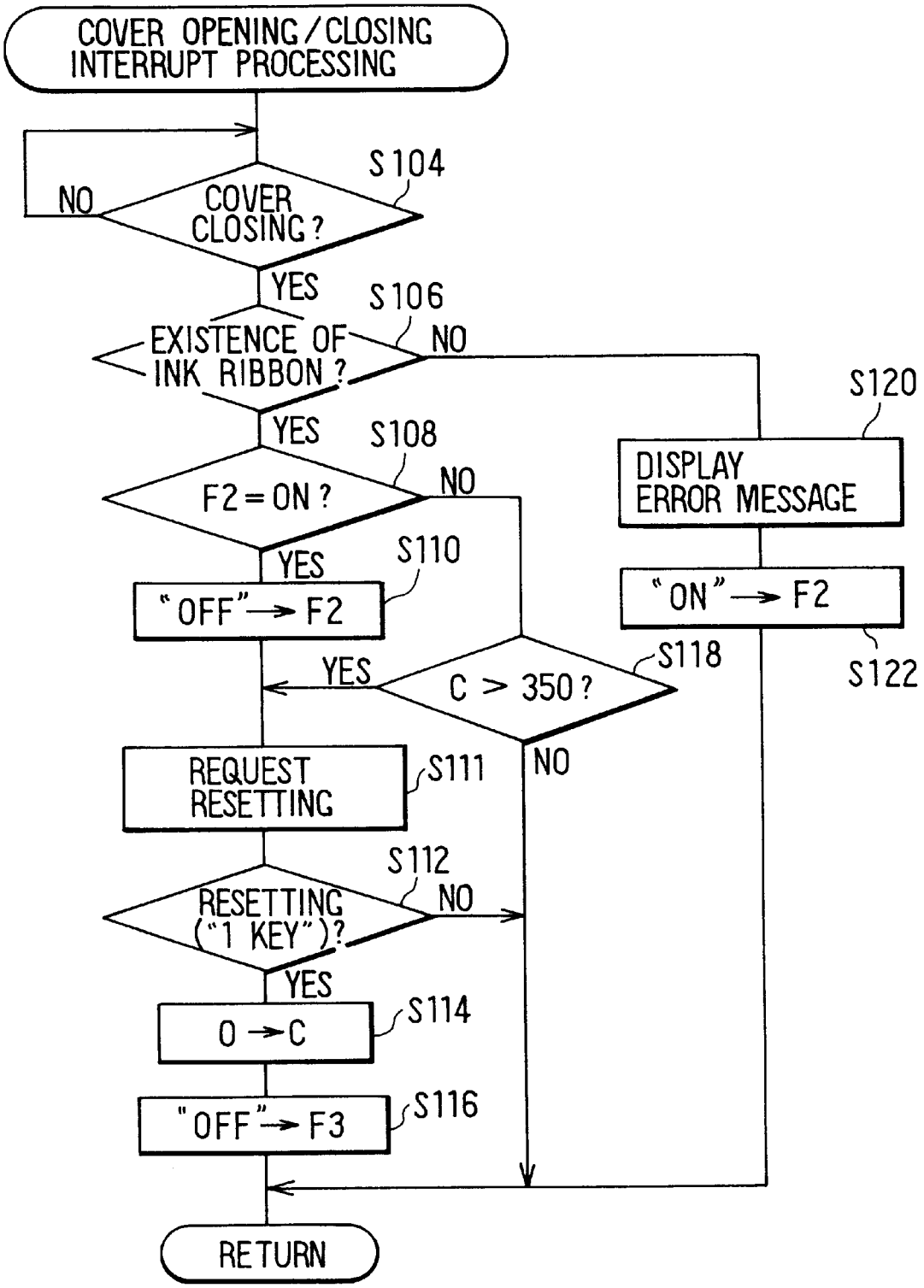
FIG. 4 is a flowchart of a cover opening/closing interrupt processing according to a first embodiment of the present invention.

A cover opening/closing interrupt processing executed by the CPU 21 when the upper cover 1 is opened and then closed in association with an operation of an ink cartridge exchange will be described next with reference to a flowchart of FIG. 4. This interrupt processing is executed when the upper cover sensor 37 is changed from OFF to ON as the upper cover 1*c* is opened.

When the cover opening/closing interrupt processing is started, it is determined first whether the upper cover 1*c* is closed (S104). As long as the upper cover 1*c* is open (S104: NO), the LCD 8 may display a message indicative of "COVER OPEN". Subsequently, when the upper cover 1*c* is closed and the upper cover sensor 37 is changed from ON to OFF (S104: YES). The ink ribbon sensor 36 checks the existence of the ink ribbon 16*c* (S106).

The ink ribbon sensor 36 is composed of a touch-sensor switch which turns to OFF when contacted with the ink ribbon 16*c*. This ink ribbon sensor 36 is turned to ON when the ink ribbon cartridge 16 is not loaded or when the ink ribbon 16*c* is fully rewound by the ink ribbon collection unit 16*b*.

If the ink ribbon sensor 36 is OFF (S106: YES) indicating the existence, then OFF is set to a ribbon shortage flag F2 (S110) and the user is requested to execute a reset operation if necessary (S111). More specifically, two messages indicative of "RIBBON EXCHANGED?" and "1. YES 2. NO" may be alternately displayed on the LCD 8 at the interval of two seconds, thereby requesting the user to select any one of "1 key" and "2 key".

If the user operates "1 key", then the reset operation is executed (S112: YES). If on the other hand the user operates "2 key", then the reset operation is not executed (S112: NO). If 60 seconds elapses without any operation, then it is automatically determined that the reset operation is not executed (S112: NO).

Then, if the reset operation is executed (S112: YES), then the printing paper counter C is reset or initialized to zero (S114). Then, OFF is set to a warning flag F3 (S116) and this processing ends. The printing paper counter C is a memory area maintained within the EEPROM 23 in order to accumulate the number of printing paper. In a printing processing described below, the printing paper counter C accumulates the number of printing papers each time the printing of one page ends. If the reset operation is not executed (S112: NO), then this processing ends.

If the ribbon shortage flag F2 is OFF in the processing S108, this means that the upper cover 1*c* was opened and closed before the ribbon shortage. Therefore, it is difficult to determine whether the ink ribbon cartridge 16 presently in use is an old one or a new one, i.e., whether only the upper cover 1*c* is opened and closed.

In this instance, therefore, it is checked whether the value of the printing paper counter C is in excess of a reset reference 350 (S118). If it is in excess of 350 (S118: YES), it is estimated to be highly likely that the ink ribbon cartridge 16 is exchanged to a new one. The processing thus proceeds to display a request message for necessity of resetting (S111, S112) to enable the user to manually reset ("1 key"). If it is not in excess of 350 (S118: NO), on the other hand, it is estimated to be highly likely that the old ink ribbon cartridge 16 is used continuously and the processing ends.

If the ink ribbon sensor 36 is ON regardless of the fact that the upper cover 1*c* is closed, i.e., the user forgot loading of the ink ribbon cartridge 16 (S106: NO), then the succeeding printing processing cannot be executed. Hence, an error message indicative of ink ribbon shortage is displayed on the LCD 8 (S120). Then, ON is set to the ribbon shortage flag F2 (S122), and this processing ends.

As described above, in this facsimile apparatus 1, when the upper cover 1*c* is opened and closed, the above interrupt processing is executed. In that case, if the ribbon shortage is detected before the upper cover 1*c* is opened and closed, or if the value of the first printing paper counter C exceeds 350, then the user is requested to execute the reset operation if necessary. If the user executes the reset operation, then the value of the printing paper counter C is reset. If on the other hand the user does not execute the reset operation, then the accumulated value of the printing paper counter C is maintained as it is. Further, if the ribbon shortage is not detected before the opening/closing operation and the accumulated value of the printing paper counter C is less than 350, no reset operation is requested and the accumulated value of the counter C is maintained.

Figure 5:
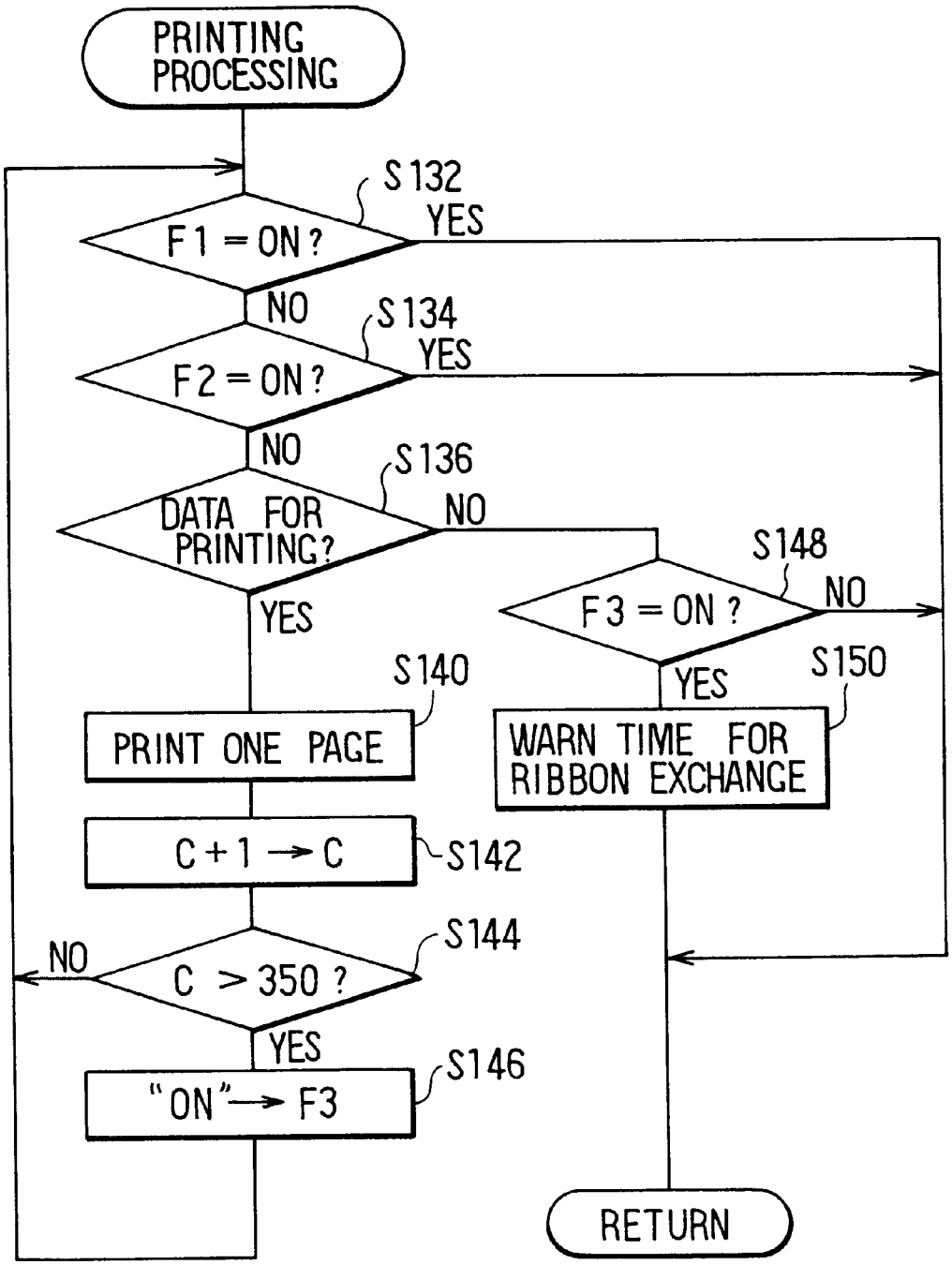
FIG. 5 is a flowchart of a print processing according to the first embodiment of the present invention.

The printing processing in the facsimile apparatus 1 is executed as shown in a flowchart of FIG. 5. This printing processing is executed if image data to be printed exists such as when a facsimile image received at the facsimile apparatus 1 is printed or when an image read out by the scanner unit 27 of the facsimile apparatus 1 is printed. During this printing processing is executed, there are executed a count processing for counting the number of printing papers used in the printing and an ink exchange time warning processing for issuing on the basis of counted results obtained by this count processing warning to the time when the ink ribbon cartridge 16 is exchanged.

When the printing processing is started, the CPU 21 checks the ON/OFF of a printing paper shortage flag F1 maintained within the RAM 24 (S132). ON is set to the printing paper shortage flag F1 in the interrupt processing executed when the printing paper sensor 35 is changed from OFF to ON in accordance with the shortage of the printing paper. On the other hand, OFF is set to the printing paper shortage flag F1 in the interrupt processing executed when the printing paper sensor 35 is changed from ON to OFF in accordance with the supply of the printing paper. If the printing paper shortage flag F1 is ON (S132: YES), then it is regarded that printing paper necessary for printing is not set, and hence the printing processing ends.

If on the other hand the printing paper shortage flag F1 is OFF in the processing executed at the step S132 (S132: NO), then the ON/OFF of the ribbon shortage flag F2 is checked (S134). This ribbon shortage flag F2 is set, as described in the cover opening/closing interrupt processing, to ON when the ink ribbon 16*c* cannot be detected by the ink ribbon sensor 36. If the ink ribbon shortage flag F2 is ON (S134: YES), then it is regarded that there is no ink ribbon 16*c* necessary for printing, and hence the printing processing ends.

Though not described in detail, it is preferable that, if the printing is stopped subsequent to the processing of the steps S132 and S134, an error message display processing is executed after this processing ends.

In the processing of S134, if the ink ribbon 16*c* is set (S134: NO), then it is checked whether or not there is data to be printed (S136). If there is data to be printed (S136: YES), then the printing of one page is executed (S140).

The printing of one page is a processing similar to the processing executed by a conventional facsimile apparatus, and will be described only in brief below. That is, the printing of one line and the transport of printing paper necessary for a start of one line are alternately repeated by the amount of necessary lines. After the printing of necessary lines ends, printing paper necessary for a line of new paragraph is transported. When the printing paper is transported, the ink ribbon 16*c* also is simultaneously transported while it is in close contact with the printing paper. At that time, it is frequently observed that the printing paper or the ink ribbon 16*c* runs short. In that case, the interrupt processing is executed as described above so that the printing paper shortage flag F1 or the ribbon shortage flag F2 is set to ON. Then, this printing processing is stopped. Also, during the printing, an indication indicative of printing is displayed on the LCD 8.

If the printing of one page ends in this way, 1 is added to the printing paper counter C (S142). The printing paper counter C is already reset during the cover opening/closing interrupt processing of FIG. 4. Thereafter, the counter C is increased in an incrementing order in the processing of the step S142 with the result that the number of printing papers used is accumulated.

Subsequently, it is checked whether or not the accumulated value of the printing paper counter C exceeds 350 which is the warning reference (S144).

In the facsimile apparatus 1, the ink ribbon 16*c* is about 135 m in length, and the printing can be executed about 400 times in average when an A4-size document is printed out. Accordingly, if the value of the printing paper counter C exceeds 350, then it can be assumed that the printing will be executed only about 50 times more. Therefore, if the value of the printing paper counter C is not more than 350 (S144: NO), then control returns to the processing of S132. If the value of the printing paper counter C is greater than 350 (S144: YES), ON is set to the warning flag F3 maintained within the RAM 24 (S146) for a display of warning. The control returns to the processing of S132.

Thereafter, as long as the shortage of printing paper and the shortage of ink ribbon do not occur (S132: NO, S134: NO) and there is data to be printed (S136: YES), then the steps from S132 to S146 are executed repeatedly.

If there is no data to be printed by the processing of S136 (S136: NO), then it is checked whether or not the warning flag F3 is ON (S148). If the warning flag F3 is ON (S148: YES), then there is given a warning indicating that it is almost the time to exchange the ink ribbon 16 (S150). Then, this processing ends. If on the other hand the warning flag F3 is OFF (S148: NO), then this processing ends as it is. As the warning indicating the time to exchange the ink ribbon 16 to a new one, to be specifically, a warning sound of 0.1 second is emanated from the speaker 3 three times and a message of "CAUTION:SHORTAGE OF RIBBON" is displayed on the LCD 8. The indication on the LCD 8 is intermittently displayed at the interval of two seconds until OFF is set to the warning flag F3.

In this connection, OFF is set to the warning flag F3 when a stop key is operated in another processing or when the printing paper counter C is reset, whereby the warning indicating that the ink ribbon should be exchanged is stopped. However, when only the stop key is operated and the printing paper counter C is not reset, then ON is immediately set to the warning flag F3 in the next printing processing. For this reason, so long as the printing paper counter C is not reset, a warning is executed each time the printing processing is executed.

As described above, in this facsimile apparatus 1, if the accumulated value of the printing paper counter C exceeds 350 which is the warning reference and the reset reference, then it is determined that the ink ribbon cartridge 16 should be exchanged, and a warning is given. Therefore, the ink ribbon 16 can be exchanged at a suitable time.

In addition, if the upper cover 1*c* is opened and closed at that time, then it is requested to execute the reset operation if necessary. Thus, the user can initialize the value of the printing paper counter C in response to the status of whether or not the ink ribbon cartridge 16 is exchanged to the new one.

If the accumulated value of the printing paper counter C is not in excess of 350 (warning reference and resetting reference), no warning is issued. Even when the upper cover 1c is opened and closed at this time, it is automatically determined that the ink cartridge is not exchanged to the new one and the counter C is not reset. Therefore, no manual operation by the user for prohibiting the initialization of the counter C is necessitated. Thus, it does not occur that the counter C is initialized through erroneous manual operation by the user within a short period of time after an exchange of ink cartridge to a new one.

Further, even when the accumulated value of the counter C is less than 350, it is requested to execute the reset operation when necessary, once the ink ribbon cartridge 16 is exchanged to the new one in response to the ink ribbon shortage occuring befrore the opening/closing of the upper cover 1*c*.

In the first embodiment, the warning reference and the resetting reference may be set separately to different values. If the resetting reference is set smaller than the warning reference, it becomes possible to have a resetting timing at an early stage without issuing the warning at too early time.

(Second Embodiment)

Figure 6:
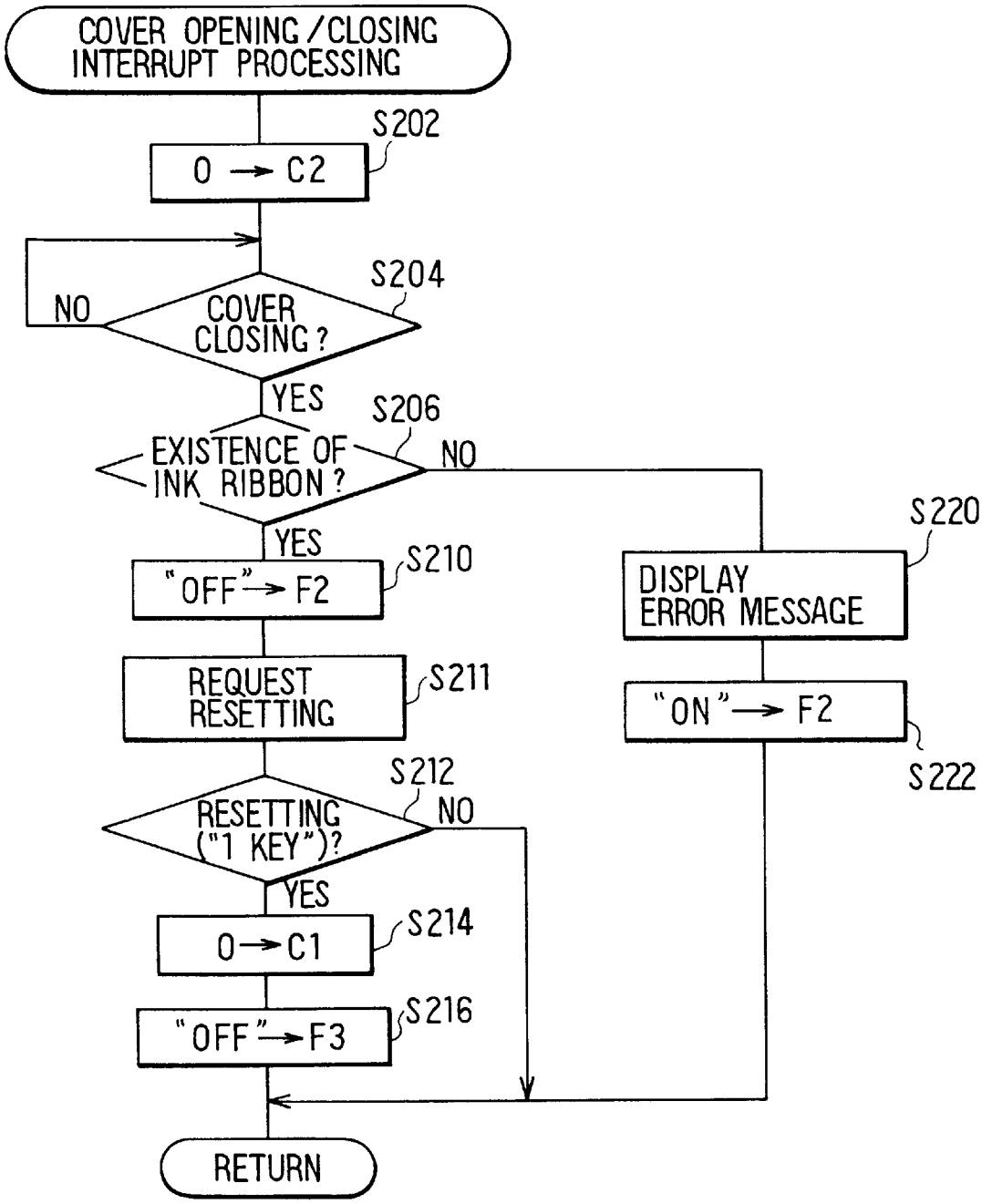
FIG. 6 is a flowchart of a cover opening/closing interrupt processing according to a second embodiment of the present invention.
Figure 7:
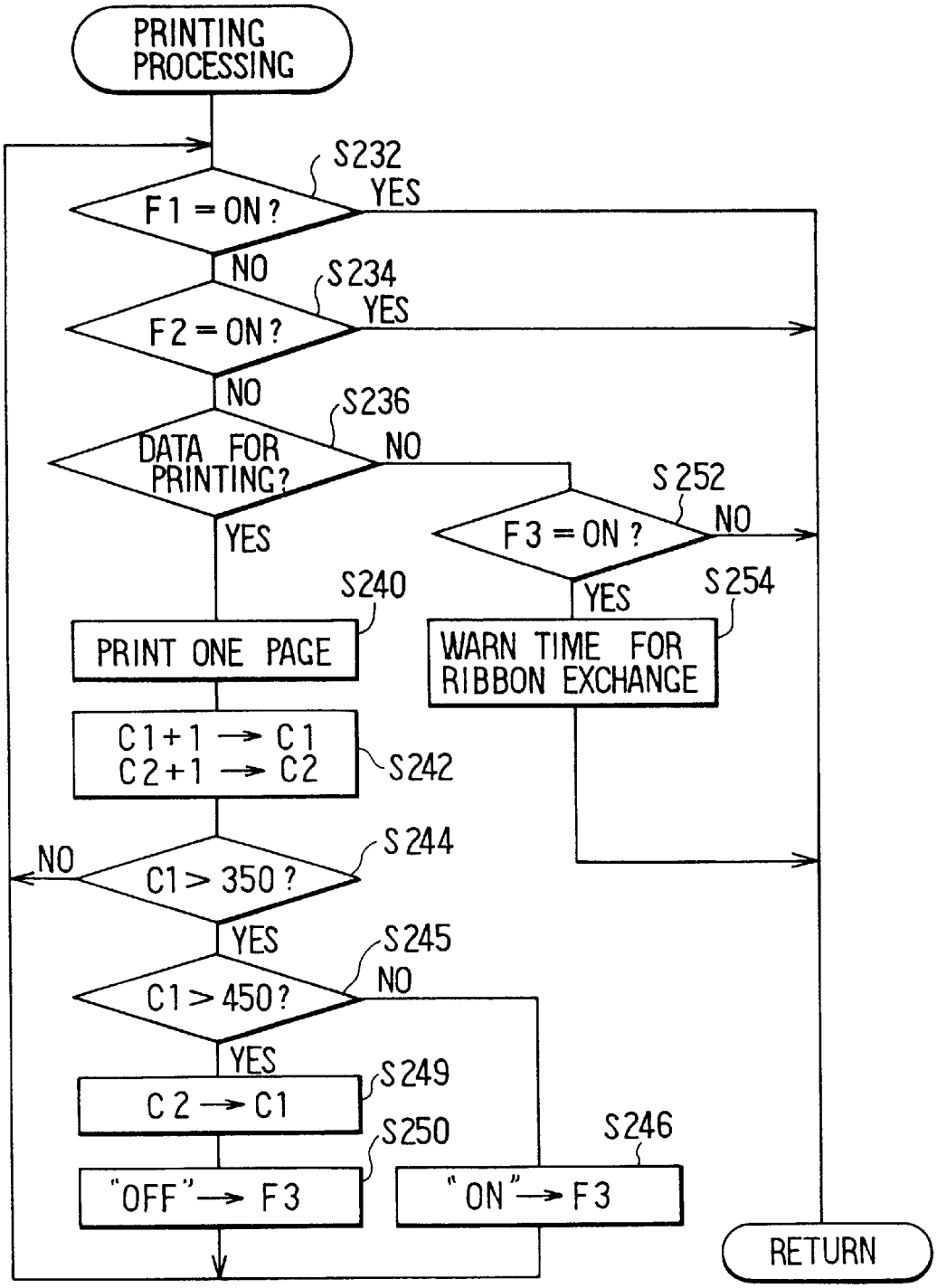
FIG. 7 is a flowchart of a print processing according to the second embodiment of the present invention.
Figure 8:
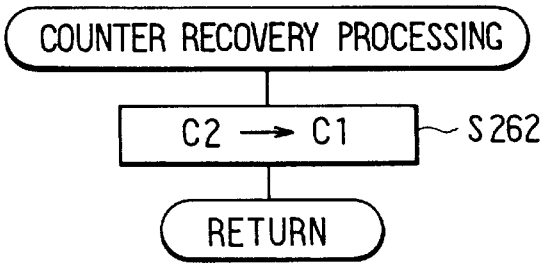
FIG. 8 is a flowchart of a counter reset processing according to the second embodiment of the present invention.

In a second embodiment shown in FIGS. 6 to 8, when the cover opening/closing interrupt processing of FIG. 6 is started, that is, when an operation associated with an exchange of ink cartridge is detected, the CPU 21 initially resets or initializes a second printing paper counter C2 to zero (S202) and is placed in the standby state until it is determined that the upper cover 1*c* is closed (S204: NO). At that time, the LCD 8 displays a message indicative of "COVER OPEN". The second printing paper counter C2 is a memory area maintained within the EEPROM 23 in order to accumulate the number of printing papers each time the printing of one page ends in a printing processing.

Subsequently, when the upper cover 1*c* is closed and the upper cover sensor 37 is changed from ON to OFF (S204:

YES). The ink ribbon sensor 36 checks the existence of the ink ribbon 16*c* (S206) which turns to OFF when contacted with the ink ribbon 16*c*. This ink ribbon sensor 36 is turned to ON when the ink ribbon cartridge 16 is not loaded or when the ink ribbon 16*c* is fully rewound by the ink ribbon collection unit 16*b*.

If the ink ribbon sensor 36 is OFF (S206: YES) indicating the existence, then OFF is set to a ribbon shortage flag F2 (S210) and the user is requested to execute a reset operation if necessary. More specifically, two messages indicative of "RIBBON EXCHANGED?" and "1. YES 2. NO" are alternately displayed on the LCD 8 at the interval of two seconds, thereby requesting the user to select any one of "1 key" and "2 key" (S211). It is determined if the user has operated "1 key" for resetting or "2 key" for not resetting (S212). If 60 seconds elapsed without any operation, then it is automatically determined that the reset operation is not executed (S212: NO).

If the reset operation is executed (S212: YES), then a first printing paper counter Cl is reset (S214). Then, OFF is set to a warning flag F3 (S216) and this processing ends. Similarly to the second printing paper counter C2, the first printing paper counter C1 also is a memory area maintained within the EEPROM 23 in order to accumulate the number of printing paper. In this printing processing, the first printing paper counter C1 accumulates the number of printing papers each time the printing of one page ends. If the reset operation is not executed (S212: NO), then this processing ends.

If the ink ribbon sensor 36 is ON regardless of the fact that the upper cover 1*c* is closed, i.e., the user forgot loading of the ink ribbon cartridge 16 (S206: NO), then the succeeding printing processing cannot be executed. Hence, an error message indicative of ink ribbon shortage is displayed on the LCD 8 (S220). Then, ON is set to the ribbon shortage flag F2 (S222), and this processing ends.

A printing processing in the facsimile apparatus 1 is executed as shown in a flowchart of FIG. 7. This printing processing is executed if image data to be printed exists.

When the printing processing is started, the CPU 21 checks the ON/OFF of a printing paper shortage flag F1 maintained within the RAM 24 (S232). ON may be set to the printing paper shortage flag F1 in the interrupt processing executed when the printing paper sensor 35 is changed from OFF to ON in accordance with the shortage of the printing paper. On the other hand, OFF is set to the printing paper shortage flag F1 in the interrupt processing executed when the printing paper sensor 35 is changed from ON to OFF in accordance with the supply of the printing paper. If the printing paper shortage flag F1 is ON (S232: YES), then it is regarded that printing papers necessary for printing are not set, and hence the printing processing ends.

If on the other hand the printing paper shortage flag F1 is OFF in the processing executed at the step S232 (S232: NO), then the ON/OFF of the ribbon shortage flag F2 is checked (S234). This ribbon shortage flag F2 is ON when the ink ribbon 16*c* cannot be detected by the ink ribbon sensor 36. If the ink ribbon shortage flag F2 is ON (S234: YES), then it is regarded that there is no ink ribbon 16*c* necessary for printing, and hence the printing processing ends.

Though not described in detail, it is preferable that, if the printing is stopped by the processing of the steps S232 and S234, an error message display processing is executed after this processing ends.

In the processing of S234, if the ink ribbon 16*c* is set (S234: YES), then it is checked whether or not there is data to be printed (S236). If there is data to be printed (S236: YES), then the printing of one page is executed (S240).

If the printing of one page ends, 1 is added to the first printing paper counter C1 and the second printing paper counter C2, respectively (S242). These printing paper counters C1, C2 are already reset during the cover opening/closing interrupt processing as described with reference to FIG.6. Thereafter, these counters C1, C2 are increased in an incrementing order in the processing of the step S242 with the result that the number of printing papers is accumulated.

Subsequently, it is checked whether or not the value of the first printing paper counter C1 exceeds 350 which is the warning reference (S244). If the value of the first printing paper counter C1 exceeds 350 (S244: YES), it is further checked whether or not the value of the first printing paper counter C1 exceeds 450 which is an accumulated value updating reference (S245).

In the facsimile apparatus 1 according to this invention, the printing can be executed about 400 times in average when an A4-size original document is printed out. Accordingly, if the value of the first printing paper counter C1 exceeds 350, then it can be assumed that the printing will be executed only about 50 times more. Also, the updating reference 450 is a value which results from adding 50 to 400 sheets of printing paper which can be printed out as an error. Therefore, if the value of the first printing paper counter C1 is not more than 350 (S244: NO), then control returns to the processing of S232. If the value of the first printing paper counter C1 is greater than 350 and not more than 450 (S244: YES, S245: NO), then warning is made after the printing ends. Hence, ON is set to the warning flag F3 maintained within the RAM 24 (S246), and control returns to the processing of S232.

If on the other hand the value of the first printing paper counter C1 exceeds 450, then it can be assumed that the accumulated value of the first printing paper counter C1 is not reset properly when the ink ribbon cartridge 16 is exchanged to the new one. However, when the ink ribbon cartridge 16 is exchanged, the cover opening/closing interrupt processing is executed and the accumulated value of the second printing paper counter C2 is reset unconditionally so that the correct number of printing papers obtained after the ink ribbon cartridge 16 was exchanged was accumulated in the second printing paper counter C2. Accordingly, if the value of the first printing paper counter C1 exceeds 450 (S244: YES, S245: YES), then the value of the second printing paper counter C2 is copied to the first printing paper counter C1 (S249) and then OFF is set to the warning flag F3 (S250). Then, control returns to the processing of S232.

Thereafter, the shortage of printing paper and the shortage of ink ribbon do not occur (S232: NO, S234: NO). Also, if there is still data to be printed (S236: YES), then the steps from S232 to S250 are executed repeatedly.

If there is no data to be printed by the processing of S232 to S250 (S236: NO), then it is checked whether or not the warning flag F3 is ON (S252). If the warning flag F3 is ON (S252: YES), then there is issued a warning indicating the time at which the ink ribbon 16 should be exchanged (S254). Then, this processing ends. If on the other hand the warning flag F3 is OFF (S252: NO), then this processing ends as it is. As the warning indicating the time at which the ink ribbon 16 should be exchanged, to be specifically, a warning sound of 0.1 second is emanated from the speaker 3 three times and a message of "CAUTION:SHORTAGE OF RIBBON" is displayed on the LCD 8. The indication on the LCD 8 is intermittently displayed at the interval of two seconds until OFF is set to the warning flag F3.

In this connection, OFF is set to the warning flag F3 when a stop key is operated in another processing or when the first printing paper counter C1 is reset, whereby the warning indicating that the ink ribbon should be exchanged is stopped. However, when only the stop key is operated and the first printing paper counter C1 is not reset, if the value of the first printing paper counter C1 exceeds 350, then ON is immediately set to the warning flag F3 in the next printing processing. For this reason, so long as the value of the first printing paper counter C1 is more than 350, a warning is executed each time the printing processing is executed.

As described above, in this embodiment, if it is neglected until the accumulated value of the first printing paper counter C1 exceeds 450, then the value of the second printing paper counter C2 which is initialized at every operning/closing of the upper cover 1*c* is automatically copied to the first printing paper counter C1. In general, the value of the second printing paper counter C2 can be copied to the first printing paper counter C1 when the user operates a counter reset key on the key input device 6.

Specifically, when a counter recovery key of the key input device 6 is operated, the CPU 21 executes a counter recovery processing shown in FIG. 8 to copy the value of the second printing paper counter C2 to the first printing paper counter C1 (S262). Accordingly, if the user becomes aware later that the reset operation is not properly executed when the ink ribbon cartridge 16 was exchanged, then before the value of the first printing paper counter C1 exceeds 450, the value of the first printing paper counter C1 can be made the same as that obtained when the reset operation is properly executed only by operating the counter recovery key.

As described above, in this facsimile apparatus 1, if the value of the first printing paper counter C1 exceeds 350 which is the warning reference, then it is determined that the ink ribbon cartridge 16 should be exchanged, and a warning is issued. Therefore, the ink ribbon 16 can be exchanged at a suitable time. In addition, if the upper cover 1*c* is opened and closed, then it is requested that the reset operation is executed in response to the necessity. Thus, the user can initialize the value of the first printing paper counter C1 in response to the status of whether or not the ink ribbon cartridge 16 is exchanged to the new one.

Further, when the ink ribbon cartridge 16 is exchanged to the new one, if the user forgets the reset operation, then the accumulated value of the first printing paper counter C1 is continuously accumulated without being reset. Therefore, even though the ink ribbon cartridge 16 is exchanged to the new one, there is given an erroneous warning one more time. In that case, when the user operates the counter reset key or it is neglected, the accumulated value of the first printing paper counter C1 is updated by the value of the second printing paper counter C2. Thus, thereafter, the accumulated value of the first printing paper counter C1 is set to a proper value so that a warning can be issued at a proper ink exchange time.

(Third Embodiment)

Figure 9:
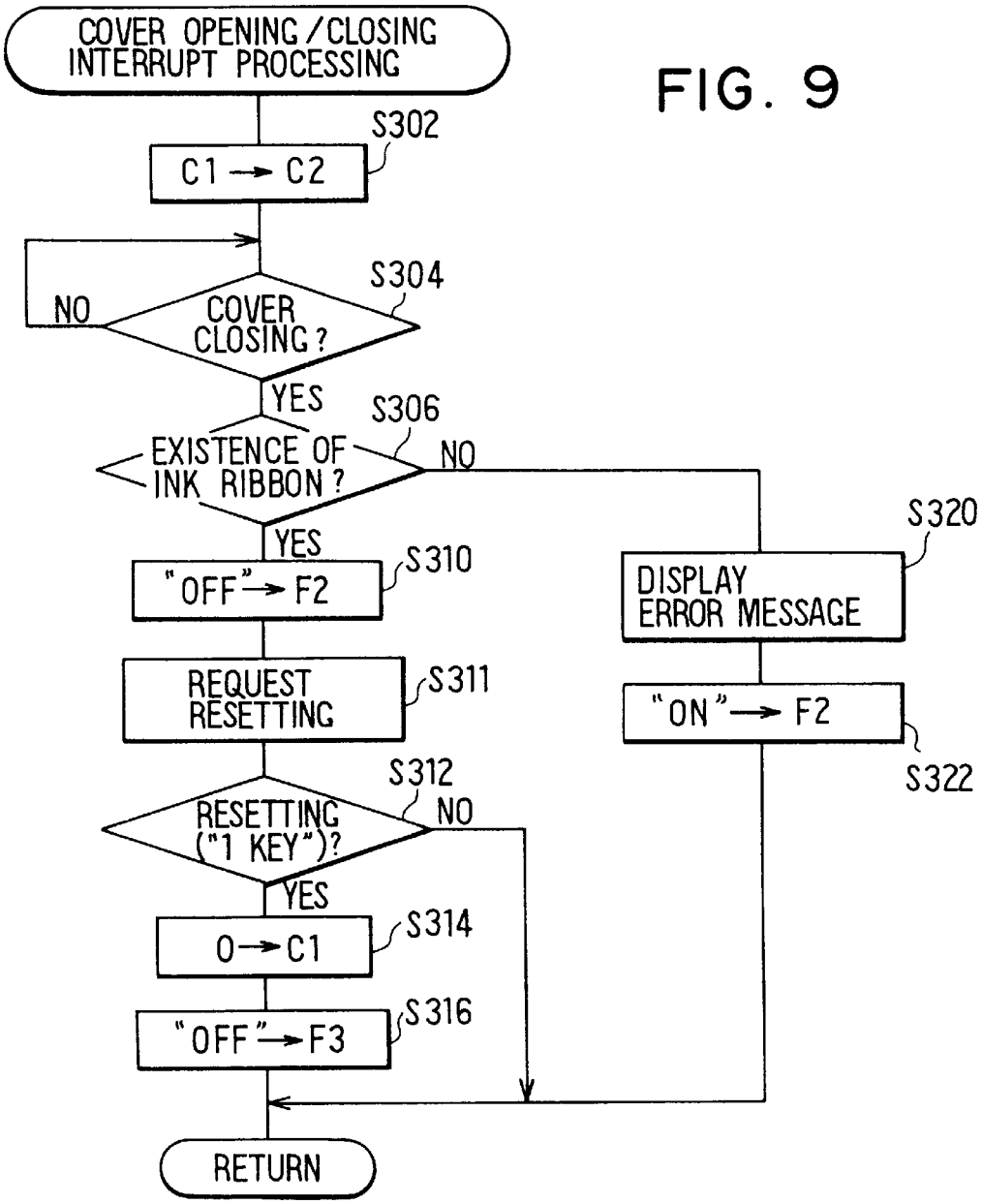
FIG. 9 is a flowchart of a cover opening/closing interrupt processing according to a third embodiment of the present invention.
Figure 10:
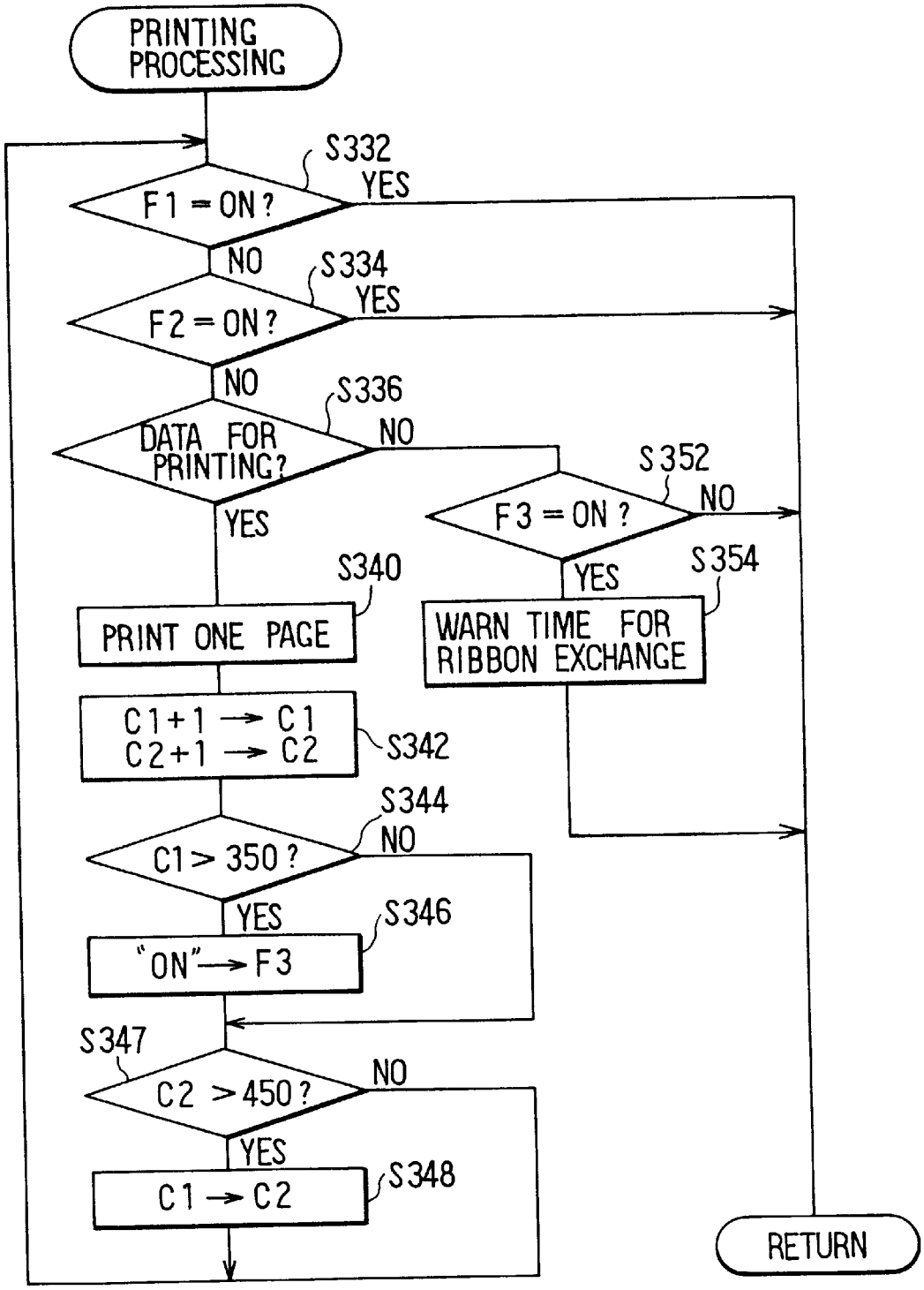
FIG. 10 is a flowchart of a print processing according to the third embodiment of the present invention.

In a third embodiment shown in FIGS. 9 and 10, when the upper cover sensor 37 is changed from OFF to ON as the upper cover 1*c* is opened, that is, when an operation associated with an ink cartridge exchange is detected, the cover opening/closing interrupt processing is executed.

When the cover opening/closing interrupt processing of FIG. 9 is started, the CPU 21 initially copies the value of the first printing paper counter C1 to the second printing paper counter C2 (S302). Then, the following steps are the same as S204 to S222 of the cover opening/closing interrupt processing according to the second embodiment.

Specifically, the facsimile apparatus 1 is placed in the standby mode until the upper cover 1*c* is closed (S304: NO). When the upper cover 1*c* is closed and the upper cover sensor 37 is changed from ON to OFF (S304: YES), it is checked by the ink ribbon sensor 36 whether or not there is the ink ribbon 16*c* (S306). If the ink ribbon sensor 36 is OFF indicating the existence of the ink ribbon (S306: YES), then OFF is set to the ribbon shortage flag F2 (S310), and the user is requested to execute the reset operation if necessary (S311). Then, if the reset operation is executed by the user (S312: YES), then the first printing paper counter C1 is reset (S314), and OFF is set to the warning flag F3 (S316). Then, this processing ends. If the reset operation is not executed (S312: NO), then this processing ends. Further, if the ink ribbon sensor 36 is ON (S306: NO) even though the upper cover 1*c* is closed, then an error message indicating the shortage of ribbon is displayed on the LCD 8 (S320) and ON is set to the ribbon shortage flag F2 (S322). Then, this processing ends.

As described above, in the above cover opening/closing interrupt processing, initially, the value of the first printing paper counter C1 is preserved in the second printing paper counter C2 unconditionally. Then, if the reset operation is executed, then only the first printing paper counter C1 is reset. Accordingly, if the ink ribbon cartridge 16 is exchanged to a new one and the reset operation is executed properly or if the ink ribbon cartridge 16 is not exchanged to a new one and the reset operation is not executed, then similarly to the second embodiment, the accumulated value of the first printing paper counter C1 becomes the number of printing papers consumed after the ink ribbon cartridge 16 was exchanged to the new one.

If on the other hand the reset operation is executed erroneously even though the ink ribbon cartridge 16 is not exchanged to the new one, then the value of the first printing paper counter C1 becomes a small value because of unnecessary resetting. In this case, unlike the second embodiment, the value accumulated in the first printing paper counter C1 when the reset operation is not executed, i.e., correct accumulated value is preserved in the second printing paper counter C2.

Then, when the printing processing of FIG. 10 is executed, the ON/OFF of the printing paper shortage flag F1 is checked (S332). If the printing paper shortage flag F1 is ON (S332: YES), then this printing processing ends. If on the other hand the printing paper shortage flag F1 is OFF (S332: NO), then the ON/OFF of the ribbon shortage flag F2 is checked (S334). Then, if the ribbon shortage flag F2 is ON (S334: YES), then this printing processing ends. If on the other hand the ribbon shortage flag F2 is OFF (S334: NO), then it is checked whether or not there is data to be printed (S336). If there is data to be printed (S336: YES), then the printing of one page is executed (S340). Then, after the printing of one page ends, 1 is added to the first printing paper counter C1 and the second printing paper counter C2, respectively (S342). Then, it is checked whether or not the accumulated value of the first printing paper counter C1 exceeds 350 which is the warning reference (S344).

Then, if the value of the first printing paper counter C1 exceeds 350 (S344: YES), then in order to issue a warning after the printing ends, ON is set to the warning flag F3 maintained within the RAM 24 (S346). Subsequently, it is checked whether or not the value of the second printing paper counter C2 exceeds 450 which is the updating reference.

If the second printing paper counter C2 exceeds 450, then it can be assumed that the ink ribbon cartridge 16 was already exchanged. However, when the ink ribbon cartridge 16 is exchanged to the new one, if the user has executed a proper operation, then at that time, the accumulated value of the first printing paper counter C1 is reset so that the correct number of printing papers consumed after the ink ribbon cartridge 16 was exchanged is accumulated in the first printing paper counter C1. Accordingly, if the value of the second printing paper counter C2 exceeds 450 (S347: YES), then the accumulated value of the first printing paper counter C1 is copied to the second printing paper counter C2 (S348), and control returns to the processing of S502.

Thereafter, if the shortage of printing paper and the shortage of ink ribbon do not occur (S332: NO, S334: NO) and there is data remaining to be printed (S336: YES), the processing of S332 to S348 is executed repeatedly.

If there is no data to be printed (S336: NO) by the processing of S332 to S348, it is checked whether or not the warning flag F3 is ON (S352). If the warning flag F3 is ON (S3552: YES), a warning indicating that the ink ribbon should be exchanged is given (S354), and this processing ends. If on the other hand the warning flag F3 is OFF (S352: NO), then this processing ends.

In this third embodiment also, when the user operates the counter recovery key on the key input device 6, the counter recovery processing shown in FIG. 8 is executed, and the value of the second printing paper counter C2 is copied to the first printing paper counter C1. Accordingly, if the reset operation is executed even though the ink ribbon cartridge 16 is not exchanged, only by operating the counter recovery key, the value of the first printing paper counter C1 can be made the same as that obtained when an erroneous reset operation is not executed.

In the third embodiment, similarly to the second embodiment, if the value of the first printing paper counter C1 exceeds 350 which is the warning reference, then it is determined that the ink ribbon cartridge 16 should be exchanged, and a warning is issued. Thus, the ink ribbon cartridge 16 can be exchanged at the proper time. In addition, when the upper cover 1*c* is opened and closed, it is requested to execute the reset operation if necessary. Thus, the user can initialize the value of the first printing paper counter C1 in response to the status of whether or not the ink ribbon cartridge 16 is exchanged to the new one.

If the user executes the reset operation even though the ink ribbon cartridge 16 is not exchanged, then the accumulated value of the first printing paper counter C1 is reset. In actual practice, a warning is not issued even though the ink ribbon cartridge 16 should be exchanged. In that case, the accumulated value of the first printing paper counter C1 is updated by the value of the second printing paper counter C2. Thus, thereafter, the accumulated value of the first printing paper counter C1 is set to a proper value so that a warning can be issued at a proper ink exchange time.

According to the third embodiment, when an unnecessary reset operation is executed erroneously, the accumulated value of the first printing paper counter C1 can be recovered to a proper value. Accordingly, if the ink ribbon cartridge 16 is hardly loaded or unloaded and the upper cover 1*c* is hardly opened and closed except when the ink ribbon cartridge 16 is exchanged to the new one, then the the second embodiment should preferably be used. Conversely, if the ink ribbon cartridge 16 is frequently loaded or unloaded except when the ink ribbon cartridge 16 is exchanged to the new one, the third embodiment should preferably be used.

(Fourth Embodiment)

A facsimile apparatus according to the fourth embodiment is made in view of the following situation. That is, whether the loading or unloading of the ink ribbon cartridge 16 is executed when the ink ribbon cartridge 16 is exchanged to the new one or in other cases depends upon the situation under which the facsimile apparatus is in use. Therefore, which of the facsimile apparatus according to the first and third embodiments should be used cannot always be determined with ease.

Figure 11:
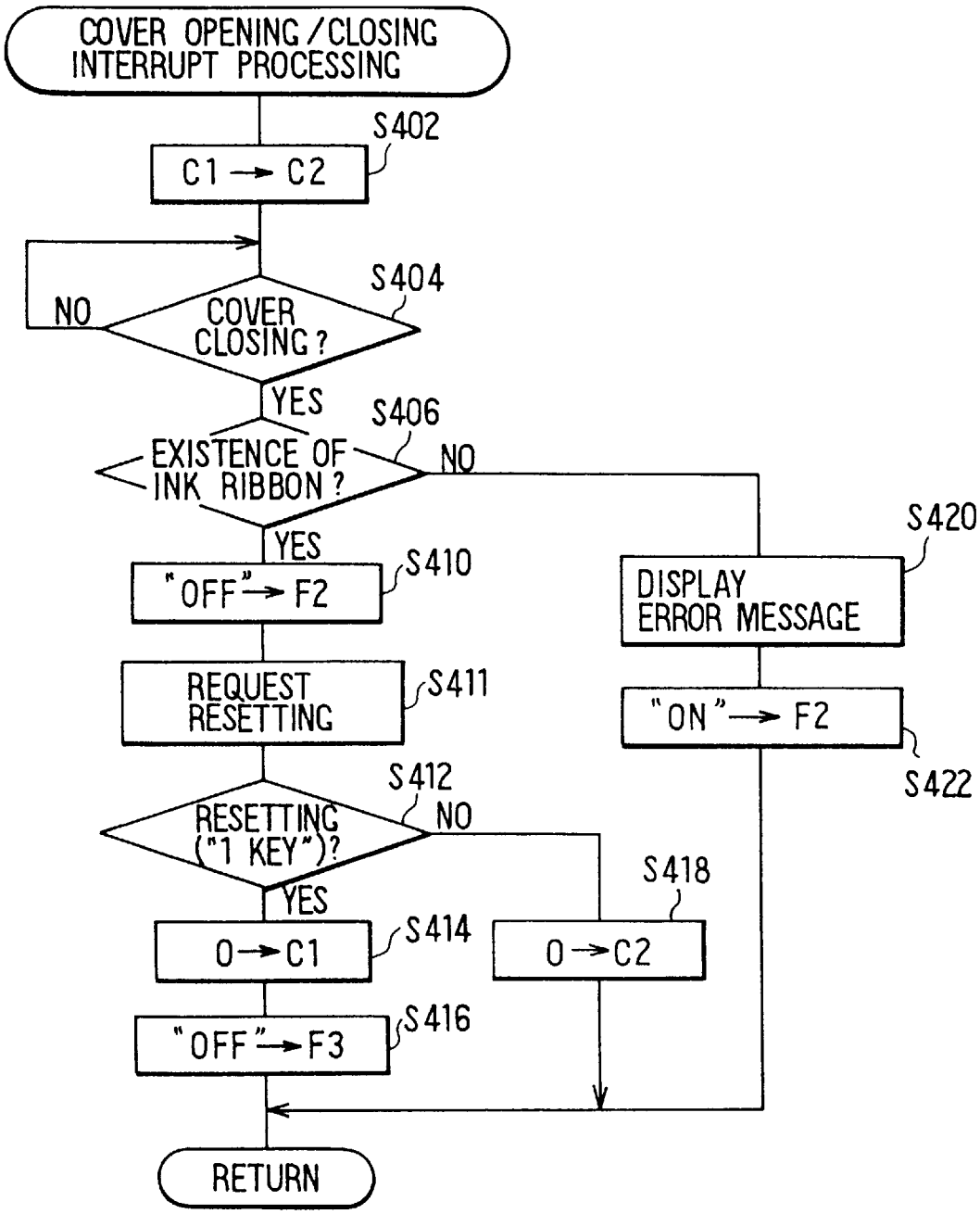
FIG. 11 is a flowchart of a cover opening/closing interrupt processing according to a fourth embodiment of the present invention.
Figure 12:
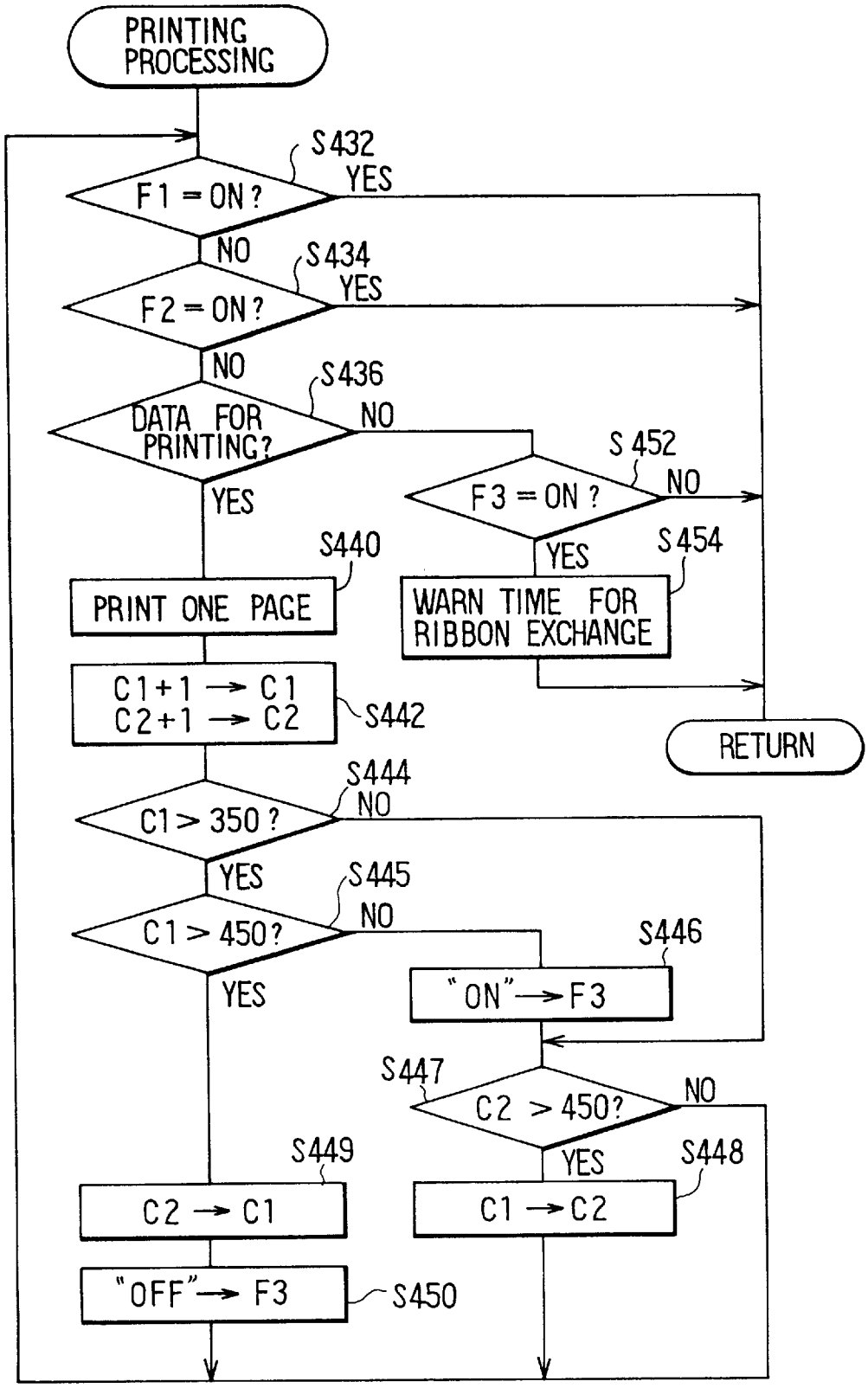
FIG. 12 is a flowchart of a print processing according to the fourth embodiment of the present invention.

In the fourth embodiment shown in FIGS. 11 and 12, when the upper cover sensor 37 is changed from OFF to ON as the upper cover 1*c* is opened, that is, when an operation associated with an ink cartridge exchange is detected, the cover opening/closing interrupt processing of FIG. 11 is executed.

When the cover opening/closing interrupt processing is started, the CPU 21 initially copies the value of the first printing paper counter C1 to the second printing paper counter C2 (S402). Then, the facsimile apparatus is placed in the standby mode until the upper cover 1*c* is closed (S404: NO). If the upper cover 1*c* is closed and the upper cover sensor 37 is changed from ON to OFF (S404: YES), it is checked by the ink ribbon sensor 36 whether or not there is the ink ribbon 16*c* (S406). If the ink ribbon sensor 36 is OFF (S406: YES), then OFF is set to the ribbon shortage flag F2 (S410), and the user is requested to execute the reset operation if necessary (S411). Then, if the reset operation is executed (S412: YES), then the first printing paper counter C1 is reset (S414), and OFF is set to the warning flag F3 (S416). Then, this processing ends.

On the other hand, in the processing of S412, if the reset operation is not executed (S412: NO), then unlike the second and third embodiments, the second printing paper counter C2 is also reset (S418), and this processing ends.

If the ink ribbon sensor 36 is ON (S406: NO) even though the upper cover 1*c* is closed, then an error message indicating the shortage of ribbon is displayed on the LCD 8 (S420) and ON is set to the ribbon shortage flag F2 (S422). Then, this processing ends.

In the cover opening/closing interrupt processing, initially, the value of the first printing paper counter C1 is preserved in the second printing paper counter C2 unconditionally. Then, if the reset operation is executed, then only the first printing paper counter C1 is reset. If on the other hand, the reset operation is not executed, then only the second printing paper counter C2 is reset.

Accordingly, if the ink ribbon cartridge 16 is exchanged to a new one and the reset operation is executed or if the ink ribbon cartridge 16 is not exchanged to a new one and the reset operation is not executed, then similarly to the second and third embodiments, the accumulated value of the first printing paper counter C1 becomes the number of printing papers consumed after the ink ribbon cartridge 16 is exchanged to the new one.

If on the other hand the reset operation is not executed even though the ink ribbon cartridge 16 is exchanged to the new one, then the value of the first printing paper counter C1 becomes a large value including the accumulated value obtained before the ink ribbon cartridge 16 is exchanged. In this case, similarly to the second embodiment, since the second printing paper counter C2 is reset automatically, a correct accumulated value is preserved in the second printing paper counter C2.

If on the other hand the reset operation is executed even though the ink ribbon cartridge 16 is not exchanged, then the value of the first printing paper counter C1 becomes a very small value in which a necessary accumulated value is reset. In this case, similarly to the third embodiment, the value set in the first printing paper counter C1 when the reset operation is not executed, i.e., correct accumulated value is preserved in the second printing paper counter C2.

In a printing processing shwon in FIG. 12, the CPU 21 starts the same processing according to the second and third embodiments.

Specifically, the ON/OFF of the printing paper shortage flag F1 is checked (S432). If the printing paper shortage flag F1 is ON (S432: YES), then this printing processing ends. If on the other hand the printing paper shortage flag F1 is OFF (S432: NO), then the ON/OFF of the ribbon shortage flag F2 is checked (S434). Then, if the ribbon shortage flag F2 is ON (S434: YES), then this printing processing ends. If on the other hand the ribbon shortage flag F2 is OFF (S434: NO), then it is checked whether or not there is data to be printed (S436). If there is data to be printed (S436: YES), then the printing of one page is executed (S440). Then, after the printing of one page ends, 1 is added to the first printing paper counter C1 and the second printing paper counter C2, respectively (S442). Then, it is checked whether or not the value of the first printing paper counter C1 exceeds 350 which is the warning reference (S444).

Then, if the value of the first printing paper counter C1 exceeds 350 (S444: YES), it is checked whether or not the value of the first printing paper counter C1 exceeds 450 which is the updating reference (S445). Here, if the value of the first printing paper counter C1 is greater than 350 and not more than 450 (S444: YES, S445: NO), ON is set to the warning flag F3 (S446).

Then, if the processing of S446 ends and if the value of the first printing paper counter C1 is not more than 350 (S444: NO), subsequently, it is checked whether or not the value of the second printing paper counter C2 exceeds 450 which is the updating reference (S447). If the value of the second printing paper counter C2 is greater than 450 (S447: YES), then the value of the first printing paper counter C1 is copied to the second printing paper counter C2 (S448), and control returns to the processing of S432.

If on the other hand the value of the first printing paper counter C1 is greater than 450 (S444: YES, S445: YES), then the value of the second printing paper counter C2 is copied to the first printing paper counter C1 (S449) and OFF is set to the warning flag F3 (S450). Then, control returns to the processing of S432.

Thereafter, if the shortage of printing paper and the shortage of ink ribbon do not occur (S432: NO, S434: NO) and there is data to be printed (S446: YES), then the processing of S442 to S450 is executed repeatedly. If there is no data to be printed (S436: NO) by the processing of S432 to S450, it is checked whether or not the warning flag F3 is ON (S452). If the warning flag F3 is ON (S452: YES), a warning indicating that the ink ribbon should be exchanged is issued (S454), and this processing ends. If on the other hand the warning flag F3 is OFF (S452: NO), then this processing ends.

Also in this facsimile apparatus, when the user operates the counter recovery key on the key input device 6, the counter recovery processing (FIG. 8) is executed, and the value of the second printing paper counter C2 is copied to the first printing paper counter C1. Accordingly, if the reset operation is not properly executed even though the ink ribbon cartridge 16 is exchanged, only by operating the counter recovery key, the value of the first printing paper counter C1 can be made the same as that provided when a reset operation is executed properly. Further, if the reset operation is executed even though the ink ribbon cartridge 16 is not exchanged, then only by operating the counter recovery key, the value of the first printing paper counter C1 can be made the same as that provided when an erroneous reset operation is not executed.

As described above, also in the fourth embodiment, similarly to the second and third embodiments, if the value of the first printing paper counter C1 exceeds 350 which is the warning reference, then it is determined that the ink ribbon cartridge 16 should be exchanged, and a warning is issued. Thus, the ink ribbon cartridge 16 can be exchanged at the proper time. In addition, when the upper cover 1*c* is opened and closed, it is requested to execute the reset operation if necessary. Thus, the user can initialize the value of the first printing paper counter C1 in response to the status of whether or not the ink ribbon cartridge 16 is exchanged to the new one.

When the ink ribbon cartridge 16 is exchanged to the new one, if the user forget resetting, the accumulated value of the first printing paper counter C1 is not reset and the accumulation is maintained. As a consequence, an erroneous warning is issued even though the ink ribbon cartridge 16 is exchanged. In that case, if the counter recovery key is operated or if the apparatus is left as it is, then the accumulated value of the first printing paper counter C1 is updated by the value of the second printing paper counter C2. Thus, thereafter, the accumulated value of the first printing paper counter C1 is set to a proper value so that a warning can be given at a proper ink exchange time.

Further, if the user executes the reset operation even though the ink ribbon cartridge 16 is not exchanged, then the accumulated value of the first printing paper counter C1 is reset. In actual practice, a warning is not issued even though the ink ribbon cartridge 16 should be exchanged. In that case, the accumulated value of the first printing paper counter C1 is updated by the value of the second printing paper counter C2. Thus, thereafter, the accumulated value of the first printing paper counter C1 is set to a proper value so that the warning can be given at a proper ink exchange time.

While the embodiments of the present invention have been described so far, the present invention is not limited thereto, and various modifications may be considered. For example, while the facsimile apparatus 1 sets 350 as the printing part exchange warning reference and 450 as the updating reference with respect to the average total printing number, i.e., 400 by the ink ribbon cartridge 16, the average total printable number may be varied depending upon the difference of the ink exchange mechanism or the like. Furthermore, the warning reference and the updating reference also are values which can be arbitrarily set by the user in response to the warning time and the automatic updating time.

While the ink exchange time warning apparatus is used by the facsimile apparatus as described above, the present invention is not limited thereto and may be used in various devices including a printing mechanism, e.g., a printer connected to a computer or the like, a word processor or a copying machine. In any cases, it is possible to achieve desired effects.

Furthermore, while the ink exchange warning apparatus uses the printing paper quantity measuring apparatus as a part thereof according to the present invention as described above, the time at which the printing papers are supplied can be specified, then it is possible to construct a printing paper supply time warning apparatus which can warn a printing paper supply time. In that case, it is possible to achieve desired effects.

Still further, the printing paper quantity to be accumulated may be a length of consumed printing papers in the case of using a printing paper roll or may be represented by other parameters such as a ratio of the consumed printing papers to the total printing papers set initially before starting printing operation. The ink exchange may be detected by button or key operation manually executed by a user at the time of, unloading/loading of an ink ribbon cartridge, ink tank cartridge or toner cartridge. The printing paper supply may be detected by button or key operation manually executed by a user at the time of supplying or refilling new printing pappers. The reset operation and the other operation may be any operations which are executed in association with the resetting and non-resetting, respectively. For instance, not only a specific reset key or button may be operated but also other general keys or buttons may be operated in a specific order as instructed by a display. The resetting and non-reset operations may be requested by displaying a visul message, sounding an audible message, lighting or buzzing.

Having described preferred embodiments of the invention with reference to the accompanying drawings, it is to be understood that the present invention is not limited to those precise embodiments and that various changes and modifications could be effected therein by one skilled in the art without departing from the spirit or scope of the invention as defined in the appended claims.

What is claimed is:

1. An apparatus comprising:

a memory for accumulating and memorizing quantity of consumed printing papers each time the printing paper is consumed in printing;

a detector for detecting a predetermined operation associated with a consumable part exchange operation executed each time the consumable part is exchanged;

operation request means for requesting in response to a detection of the predetermined operation by the detector, either one of a predetermined reset operation and another operation when an accumulated value of the memory is more than a predetermined resetting reference; and controlling means for automatically initializing the accumulated value in the memory to an initial value in response to the predetermined reset operation.

2. The apparatus as set forth in claim 1 further comprising:

a warning unit for issuing a warning when the accumulated value in the memory exceeds a predetermined warning reference, wherein the detector is disposed to detect the exchnage operation of the consumable part, the memory starts accumulation of the consumed printing papers quantity after a detection of the consumable part exchange operation, and the warning unit is connected to issue a consumable part exchange time in dependence on the accumulated value.

3. The apparatus as set forth in claim 2, further comprising:

another detector for detecting whether an ink supply is capable, wherein the operation request means requests one of the reset operation and the another operation irrespective of the accumulated value in the memory when the another detector detects a change from an ink supply incapable state to an ink supply capable state at a time of detection of the consumable part exchange operation.

4. An apparatus comprising:

first and second memories for accumulating and memorizing a quantity of consumed printing papers each time printing paper is consumed in printing;

a detector for detecting a predetermined operation executed each time a consumable part for printing is supplied;

first initialization means for initializing an accumulated value memorized in the first memory to an initial value when the detector detects the predetermined operation and a reset operation is executed;

a second initialization means for initializing an accumulated value memorized in the second memory to an initial value when the detector detects the predetermined operation;

recovery means for updating the accumulated value memorized in the first memory by the accumulated value memorized in the second memory when a predetermined recovery operation is executed manually; and controlling means for automatically updating the accumulated value memorized in the first memory by the accumulated value memorized in the second memory when the accumulated value memorized in the first memory exceeds a predetermined updating reference.

5. The apparatus as set forth in claim 4, further comprising:

operation request means for requesting either one of a manual reset operation and a manual non-reset operation different from the reset operation when the detector detects the supply operation.

6. The apparatus as set forth in claim 4, further comprising:

warning means for issuing a warning when the accumulated value memorized in the first memory exceeds a warning reference, wherein the detector detects an exchange of ink as the consumable part for printing, and the warning means issues the warning by estimating a next ink exchange time from the quantity of paper accumulated after the detected exchange of ink.

7. An apparatus comprising:

first and second memories for accumulating and memorizing quantity of consumed printing papers each time printing paper is consumed in printing;

a detector for detecting a predetermined operation executed each time a consumable part for printing is supplied;

preserving means for preserving the accumulated value memorized in the first memory in the second memory when the detector detects the predetermined operation;

first initialization means for initializing the accumulated value memorized in the first memory to an initial value after the accumulated value is preserved by the preserving means when the detector detects the predetermined operation and a reset operation is executed; and recovery means for updating the accumulated value memorized in the first memory by the accumulated value memorized in the second memory when a predetermined recovery operation is executed manually; and controlling means for automatically updating the accumulated value memorized in the second memory by the accumulated value memorized in the first memory when the accumulated value memorized in the second memory exceeds a predetermined updating reference.

8. The apparatus as set forth in claim 7, further comprising:

operation request means for requesting either one of a manual reset operation and a manual non-reset operation different from the reset operation when the detector detects the supply operation.

9. The apparatus as set forth in claim 7, further comprising:

warning means for issuing a warning when the accumulated value memorized in the first memory exceeds a warning reference, wherein the detector detects an exchange of ink as the consumable part for printing, and the warning means issues the warning by estimating a next ink exchange time from the quantity of paper accumulated after the detected exchange of ink.

10. An apparatus comprising:

first and second memories for accumulating and memorizing a quantity of consumed printing papers each time printing paper is consumed in printing;

a detector for detecting a predetermined operation executed each time a consumable part for printing is supplied;

preserving means for preserving the accumulated value memorized in the first memory in the second memory when the detector detects the predetermined operation;

first initialization means for initializing the accumulated value memorized in the first memory to an initial value after the accumulated value in the first memory is preserved when the detector detects the supply operation and a reset operation is executed;

second initialization means for initializing the accumulated value memorized in the second memory to an initial value when the detector detects the supply operation and no reset operation is executed after the detection of the supply operation; and recovery means for updating the accumulated value memorized in the first memory by the accumulated value memorized in the second memory when a recovery operation is executed; and controlling means for automatically updating the accumulated value memorized in one of the first and second memories by the accumulated value memorized in the other of the first and second memories when the accumulated value memorized in one of the first and second memories exceeds a predetermined updating reference.

11. The apparatus as set forth in claim 10, further comprising:

operation request means for requesting either one of a manual reset operation and a manual non-reset operation different from the reset operation when the detector detects the supply operation.

12. The apparatus as set forth in claim 10, further comprising:

warning means for issuing a warning when the accumulated value memorized in the first memory exceeds a warning reference, wherein the detector detects an exchange of ink as the consumable part for printing, and the warning means issues the warning by estimating a next ink exchange time from the quantity of paper accumulated after the detected exchange of ink.

13. A method for warning a consumable part exchange time comprising the steps of:

accumulating quantity of printing papers consumed in printing;

detecting a predetermined operation associated with an exchange of a consumable part for printing;

comparing the accumulated quantity with a comparison reference in response to a detection of the predetermined operation;

requesting, in response to the detection of the predetermined operation, a manual reset operation only in response to a comparison result indicating that the accumulated quantity is in excess of the comparison reference; and controlling an automatic initialization of the accumulated value to an initial value in response to an execution of the manual reset operation.

14. A method for warning a consumable part exchange time comprising the steps of:

accumulating quantity of printing papers consumed in printing separately by a first and second counters;

detecting a predetermined operation associated with an exchange of a consumable part for printing;

requesting a manual reset operation in response to the detection of the predetermined operation;

initializing the accumulated value of the first counter to an initial value in response to an execution of the manual reset operation;

controlling an automatic update of the accumulated value of the first counter by an accumulated value of the second counter when a predetermined accumulated value recovery operation is executed manually; and warning a next exchange time of the consumable part when the accumulated value of the first counter exceeds a warning reference.

15. The method as set forth in claim 14 further comprising the steps of:

initializing the accumulated value of the second counter in response to the predetermined operation irrespective of the manual reset operation; and updating the accumulated value of the first counter by the accumulated value of the second counter when the accumulated value of the first counter exceeds an updating reference larger than the warning reference.

16. The method as set forth in claim 14 further comprising the steps of:

updating the accumulated value of the second counter by the accumulated value of the first counter in response to the predetermined operation irrespective of the manual reset operation; and updating the accumulated value of the second counter by the accumulated value of the first counter when the accumulated value of the second counter exceeds an updating reference larger than the warning reference.

17. The method as set forth in claim 14 further comprising the steps of:

initializing the accumulated value of the second counter in response to an absense of the manual reset operation;

updating the accumulated value of the second counter by the accumulated value of the first counter in response to the predetermined operation irrespective of the manual reset operation; and updating the accumulated values of the first and second counters by the accumulated values of the second and first counters when the accumulated values of the first and second counters exceed an updating reference larger than the warning reference, respectively.

18. The apparatus as set forth in claim 1, wherein the consumable part is an ink ribbon and the predetermined resetting reference is set based on a length of the ink ribbon and a size of the printing paper, respectively.

19. The apparatus as set forth in claim 2, wherein the consumable part is an ink ribbon and the predetermined resetting reference is set based on a length of the ink ribbon and a size of the printing paper, respectively.

20. The apparatus as set forth in claim 2, wherein the consumable part is an ink ribbon and the predetermined warning reference is set based on a length of the ink ribbon and a size of the printing paper, respectively.

21. The apparatus as set forth in claim 4, wherein the consumable part is an ink ribbon and the predetermined updating reference is set based on a length of the ink ribbon and a size of the printing paper, respectively.

22. The apparatus as set forth in claim 6, wherein the consumable part is an ink ribbon and the warning reference is set based on a length of the ink ribbon and a size of the printing paper, respectively.

23. The apparatus as set forth in claim 6, wherein the consumable part is an ink ribbon and the predetermined updating reference is set based on a length of the ink ribbon and a size of the printing paper.

24. The apparatus as set forth in claim 9, wherein the consumable part is an ink ribbon and the warning reference is set based on a length of the ink ribbon and a size of the printing paper.

25. The apparatus as set forth in claim 9, wherein the consumable part is an ink ribbon and the predetermined updating reference is set based on a length of the ink ribbon and a size of the printing paper.

26. The apparatus as set forth in claim 12, wherein the consumable part is an ink ribbon and the warning reference is set based on a length of the ink ribbon and a size of the printing paper, respectively.

27. The apparatus as set forth in claim 13, wherein the consumable part is an ink ribbon.

28. The apparatus as set forth in claim 14, wherein the consumable part is an ink ribbon.

* * * * *